US005303511A

United States Patent [19]

Tsuchiya et al.

[11] Patent Number: 5,303,511

[45] Date of Patent: Apr. 19, 1994

[54] SPINDLE APPARATUS FOR SUPPORTING AND ROTATING A WORKPIECE

[75] Inventors: Yukiharu Tsuchiya, Nagoya; Toshio Maruyama; Kenzaburo Oishi, both of Kariya; Masakazu Yamaguchi, Nagoya; Shoichi Sano, Gamagouri; Makoto Nonoyama, Kariya, all of Japan

[73] Assignee: Toyoda Koki Kabushiki Kaisha, Kariya, Japan

[21] Appl. No.: 962,006

[22] Filed: Oct. 15, 1992

Related U.S. Application Data

[63] Continuation of Ser. No. 690,618, Apr. 24, 1991, abandoned.

[30] Foreign Application Priority Data

Apr. 27, 1990 [JP] Japan ..... 2-110254

[51] Int. Cl.[5] ..... B24B 49/00

[52] U.S. Cl. ..... 51/165.75; 51/165.77; 51/237 CS

[58] Field of Search ..... 51/165.75, 165.77, 165.78, 51/165.86, 237 R, 237 C, 105 R

[56] References Cited

U.S. PATENT DOCUMENTS

| | | | |
|---|---|---|---|
| 3,142,941 | 8/1964 | Fournier et al. | 51/237 CS |
| 3,583,108 | 6/1971 | Oishi et al. | 51/237 CS |
| 3,584,423 | 6/1971 | Hocire | 51/237 CS |
| 3,653,854 | 4/1972 | Asano . | |
| 3,680,876 | 8/1972 | Okada | 51/237 CS |
| 3,772,829 | 11/1973 | Asano et al. | 51/165.75 |
| 4,294,045 | 10/1981 | Enomoto et al. | 51/165.77 |
| 4,454,689 | 6/1984 | Giebmanns | 51/288 |

FOREIGN PATENT DOCUMENTS

| | | |
|---|---|---|
| 2202805 | 8/1972 | Fed. Rep. of Germany . |
| 277421 | 4/1990 | German Democratic Rep. . |
| 56-41925 | 10/1981 | Japan . |

*Primary Examiner*—M. Rachuba

*Attorney, Agent, or Firm*—Oblon, Spivak, McClelland, Maier & Neustadt

[57] ABSTRACT

A spindle apparatus for supporting and rotating a workpiece in a grinder. The spindle apparatus includes a workpiece spindle rotatably supported on a spindle head and driven for rotation by a motor, and a spindle plate mounted to the front end of the workpiece spindle and including an eccentric drive pin. The workpiece spindle has a bore in which a ram is axially movable. A center is fit in the front end of the ram. A unit is provided to advance the ram to engage with one end of the workpiece when the workpiece is to be supported. A rotary sleeve is rotatably supported on the front end of the ram and includes an engagement portion which is displaceable in the axial direction of the spindle and engageable with the drive pin in the direction of rotation. A driving unit is mounted to the front of the rotary sleeve to engage the workpiece in the direction of rotation when the ram is in its advanced position to thereby transmit rotation.

4 Claims, 5 Drawing Sheets

SPINDLE APPARATUS FOR SUPPORTING AND ROTATING A WORKPIECE

This application is a continuation of application Ser. No. 07/690,618, filed on Apr. 24, 1991, now abandoned.

BACKGROUND OF THE INVENTION

1. Field of the Invention

The present invention relates to a spindle apparatus for supporting and rotating a workpiece, particularly, wherein a spindle center can be displaced in the axial direction of a spindle.

2. Discussion of the Prior Art

A cylindrical grinder designed to grind a cylindrical workpiece or a cam grinder is generally constructed as shown in FIG. 1.

Specifically, a wheel head 102 and a table 103 are arranged on a bed 101 and are slidable along guides in vertical and lateral directions in the drawing, respectively. A wheel shaft 105 is supported on the wheel head 102 and is driven for rotation by a motor 106 through a belt-and-pulley mechanism 107. A pair of grinding wheels 104*a* and 104*b* are mounted to the wheel shaft 105.

A spindle head 110 is mounted on one end of the table 103. A workpiece spindle 109 is supported by the spindle head 110 and driven in rotation from a motor 108. The workpiece spindle 109 includes a chuck and a center 129. Mounted on the other end of the table 103 is a tailstock 113 including a tailstock spindle 112. The tailstock spindle 112 includes a center 111 in a face-to-face relation to the workpiece spindle 109.

A pair of workpiece stand-by stations 114*a* and 114*b* are located on the table 103 adjacent to front ends of the workpiece spindle 109 and the tailstock spindle 112. An instrument 115 is provided on the bed 101 to sense the axial or longitudinal position of a workpiece.

In the prior art, a workpiece shifter 150 is located on the table 103 between the workpiece spindle 109 and the tailstock spindle 112.

The tailstock spindle 112 or the center 111 is in its retreated position before abrasive action is initiated.

A workpiece W is loaded temporarily on the workpiece stand-by stations 115*a* and 115*b* by a loader or similar means. The workpiece W is thereafter moved toward the workpiece spindle 109 by the workpiece shifter 150 until one end of the workpiece W is brought into engagement with the center 129 of the workpiece spindle 109. The tailstock spindle 112 is then advanced so that the other end of the workpiece W is brought into engagement with the center 111.

The end of the workpiece adjacent to the workpiece spindle is gripped by the chuck of the workpiece spindle 109.

The wheel head 102 is advanced while the workpiece W is being rotated by the motor 108. The workpiece W is then abraded by the grinding wheels 104*a* and 104*b* which are rotated by the motor 106.

After abrasive or grinding action has been completed, the wheel head 102 is moved back or retreated, and the motor 108 is stopped.

The workpiece W is then released from the chuck, and the tailstock spindle 112 is moved to its retreated position. The workpiece W is thereafter moved to the workpiece stand-by stations 114*a* and 114*b* by the workpiece shifter 150 and moved away from the system by the loader.

In such a conventional grinder, loading and unloading of a workpiece requires the use of the workpiece shifter 150. A large workpiece shifter is thus necessary when a large workpiece is to be loaded and unloaded.

The workpiece W is displaced from the workpiece stand-by stations 114*a* and 114*b* toward the workpiece spindle 109 by the workpiece shifter 150. This results in an increase in the distance between one end of the workpiece W and the tailstock spindle 112. The tailstock spindle 112 must project more toward the workpiece spindle 109 or must be moved more toward the workpiece spindle 109 to support the other end of the workpiece W in proportion to the displacement of the workpiece W by the workpiece shifter 150. This impairs the rigidity of the tailstock spindle 112.

A further problem of the prior art is that it takes quite a time to support the workpiece since the workpiece shifter 150 must be used to load the workpiece, and the tailstock spindle 112 must be moved by an increased distance.

SUMMARY OF THE INVENTION

Accordingly, it is an object of the present invention to provide an improved spindle apparatus which can engage a workpiece with a workpiece spindle without the need for a workpiece shifter.

Another object of the present invention is to provide a spindle apparatus which allows a tailstock spindle to support a workpiece with a lesser amount of movement so as to increase the rigidity of the tailstock spindle and to reduce the time required to support the workpiece.

Briefly, the present invention provides a spindle apparatus which comprises a workpiece spindle rotatably supported on a spindle head and driven for rotation by a motor, a ram slidably supported in a bore of the workpiece spindle and including a workpiece support portion at its front end, a unit for moving the ram to a predetermined advanced position to support the workpiece, a drive member rotatably supported on the front end of the ram and engageable with the workpiece in the direction of rotation when the ram has been moved to its advanced position, and a mechanism for transmitting rotation of the workpiece spindle to the drive member.

With this arrangement, after the workpiece has been loaded, the ram is moved to its advanced position to support the workpiece. The workpiece is then ready to rotate. That is, when the ram is advanced, the workpiece support portion of the ram engages with the workpiece to rotatably support the workpiece. While the ram is being advanced, the drive member comes into engagement with a rotation transmission surface of the workpiece. This allows transmission of rotation of the workpiece spindle to the workpiece. Thus, the spindle apparatus eliminates the need for a workpiece shifter and its maintenance. It also provides an increased space on the grinder. This not only facilitates cleaning of the table, but also permits provision of a rest device. Additionally, the spindle apparatus can handle a workpiece of a greater weight since a workpiece shifter needs not be used to shift a workpiece.

The tailstock spindle is moved a shorter distance than the prior art when the workpiece is to be supported. This improves the rigidity of the tailstock spindle and reduces the size of the tailstock and tailstock spindle. Further, the tailstock spindle is reciprocated a lesser amount of time than the prior art, and no time is required to operate the workpiece shifter. This results in a decrease in the time required to operate the system and in an increase in the operating efficiency.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

The present invention will now be described by way of example with reference to the drawings.

Figure 1:
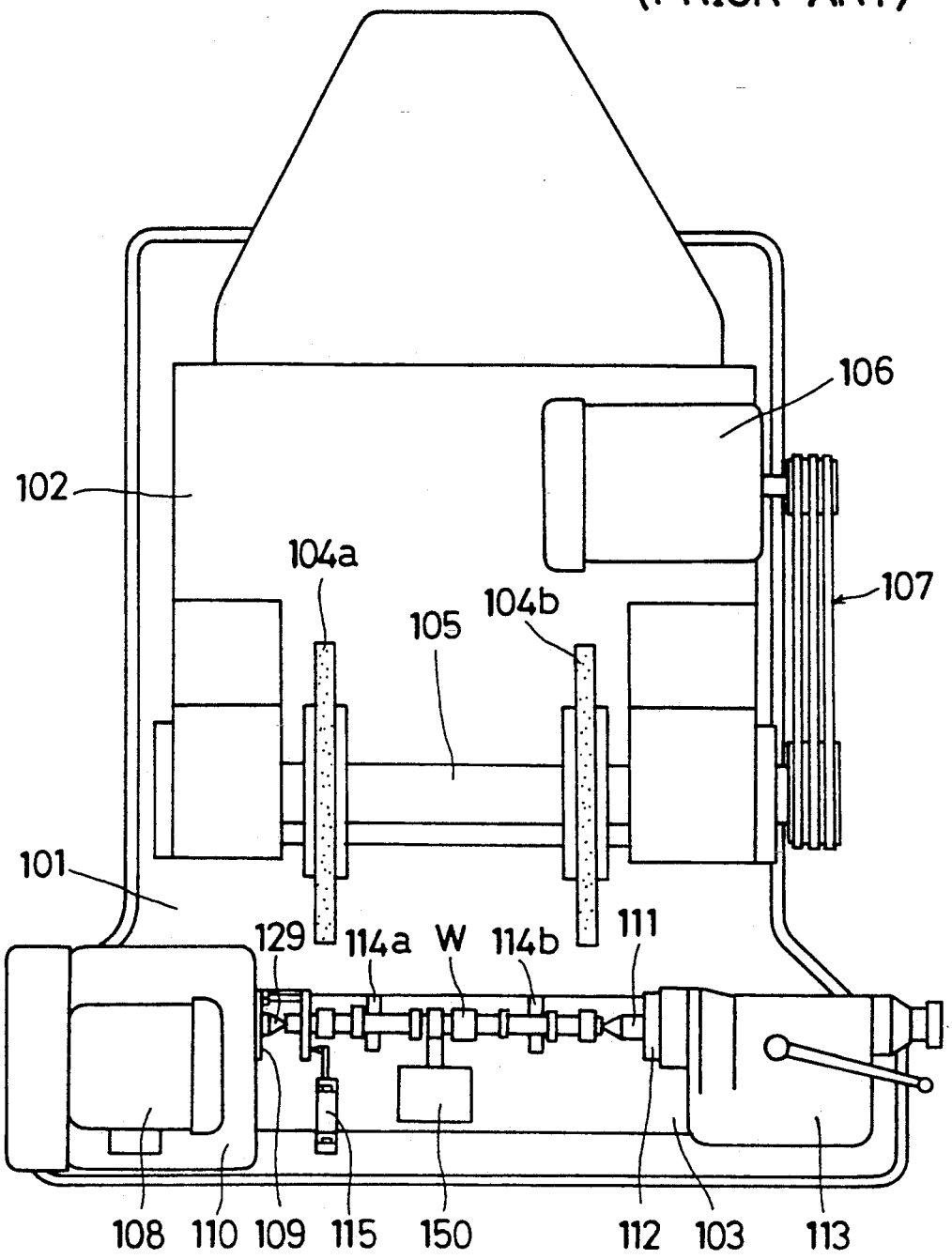
FIG. 1 (PRIOR ART)
FIG. 1 is a top plan view of a grinder with a conventional spindle apparatus.
Figure 2:
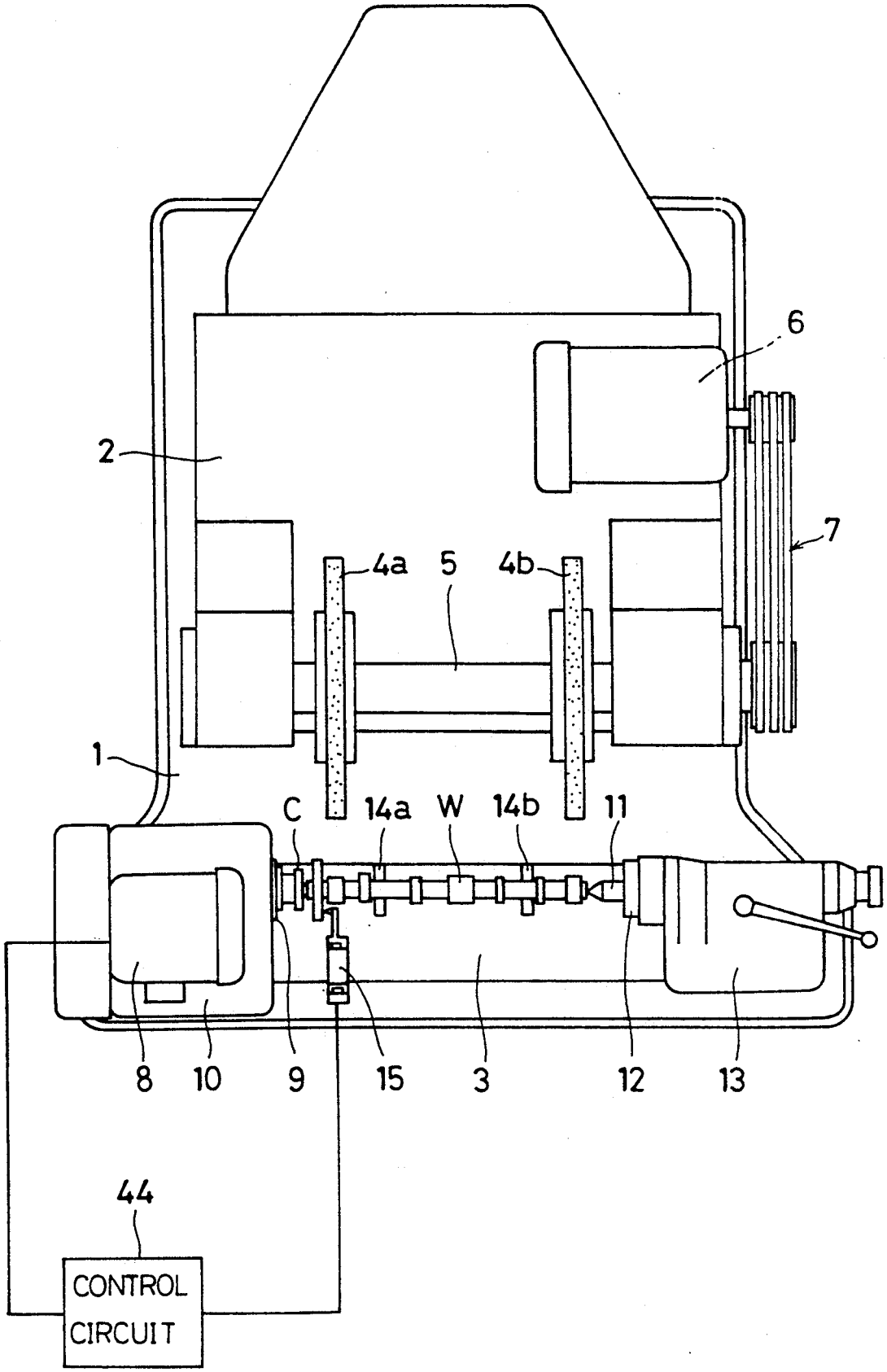
FIG. 2 is a top plan view of a grinder with a spindle apparatus according to one embodiment of the present invention.

FIG. 2 shows a grinder incorporating a spindle apparatus of the present invention.

A wheel head 2 and a table 3 are arranged on a bed 1 and slidable along guides in vertical and lateral directions in the drawing, respectively. A wheel shaft 5 is supported on the wheel head 2 and is driven for rotation by a motor 6 through a belt-and-pulley mechanism 7. A pair of grinding wheels 4*a* and 4*b* are mounted to the wheel shaft 5.

A spindle head 10 is mounted on one end of the table 3. A workpiece spindle 9 is supported by the spindle head 10 and driven in rotation from a motor 8. Mounted on the other end of the table 3 is a tailstock 13 including a tailstock spindle 12. The tailstock spindle 12 includes a center 11 in a face-to-face relation to the workpiece spindle 9.

A pair of workpiece stand-by stations 14*a* and 14*b* are located on the table 3 adjacent to front ends of the workpiece spindle 9 and the tailstock spindle 12. An instrument 15 is provided on the bed 1 to sense the axial or longitudinal position of a workpiece.

Figure 3:
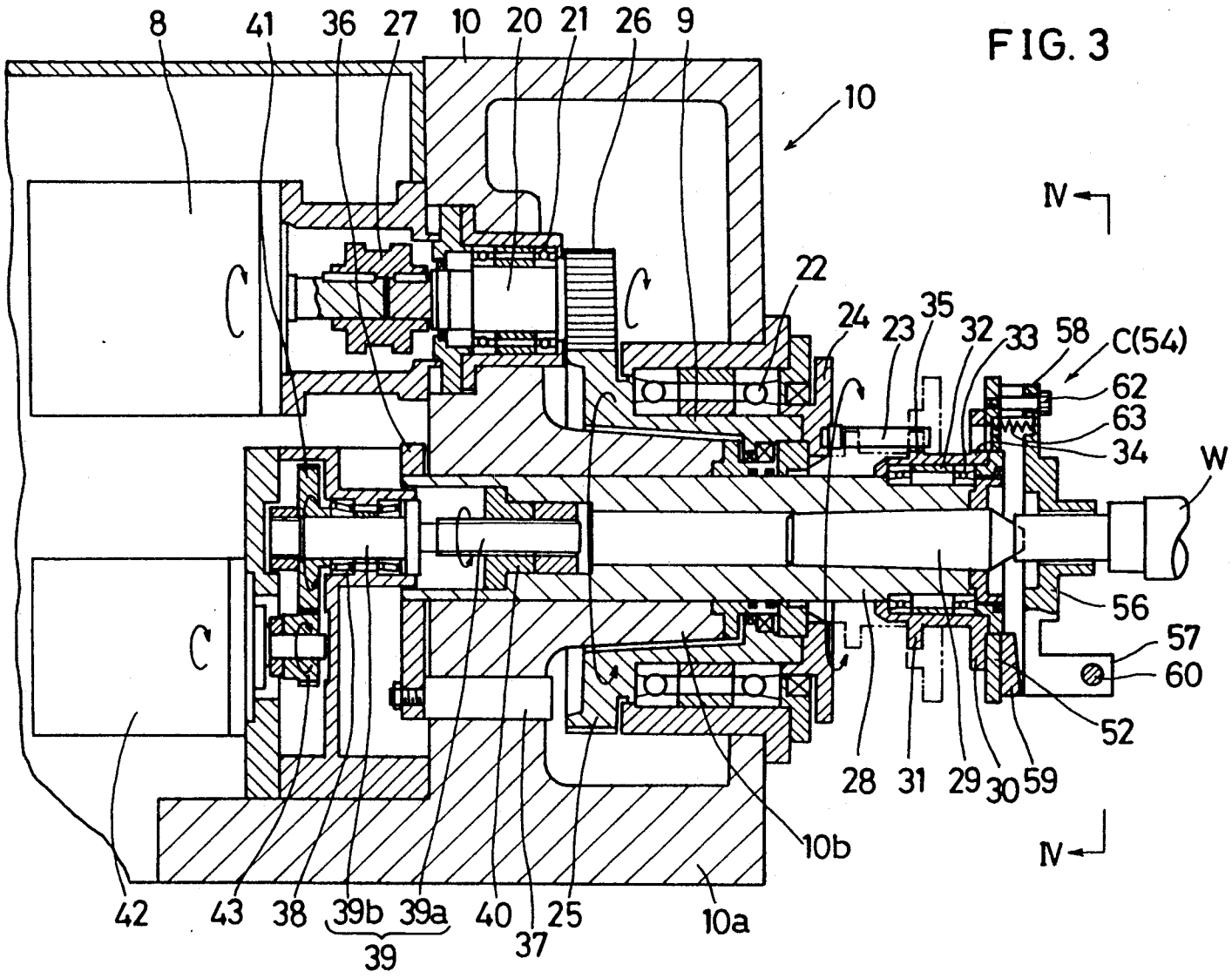
FIG. 3 is a sectional front view of a spindle apparatus according to the embodiment of the present invention.

The structure of the spindle head 10 is shown in detail in FIG. 3.

The spindle head 10 includes a body 10*a* within which the workpiece spindle 9 and a gear shaft 20 extend in parallel to one another and are rotatably supported by roller bearings 21, 21 and 22, 22, respectively. A spindle plate 24 is attached to the front end of the workpiece spindle 9 and includes an eccentric pin 23 extending axially of the spindle. A gear 25 is integrally formed on the rear end of the workpiece spindle 9 and meshed with a gear 26 which is, in turn, formed on the front end of the gear shaft 20. The rear end of the gear shaft 20 is coupled to the output shaft of the motor 8 through a joint 27.

The workpiece spindle 9 includes an axially extending central bore. A ram support 10*b* is integral with the body 10*a* and has a front end extending into the central bore of the workpiece spindle 9 with a predetermined clearance left therebetween. A ram 28 extends into the ram support 10*b* and is slidable in a direction parallel to the axis of the workpiece spindle 9. A rod 37 is mounted within the body 10*a* and slidable in a direction parallel to the axis of the ram 28. The rear ends of the rod 37 and the ram 28 are interconnected together by a connecting plate 36. This allows the ram 28 to axially move, but restricts the ram 28 from rotating.

A center 29 is fit in the front end of the ram 28. A rotary sleeve 32 is also rotatably mounted on the front end of the ram 28 through roller bearings 33 and 33. The rotary sleeve 32 includes a front flange 30 and a rear flange 31. The rear flange 31 has a groove 35 to receive the drive pin 23 which in turn, extends from the spindle plate 24. The front flange 30 has an opening 34 so as to prevent interference of the drive pin 23 with the front flange 30 when the ram 28 is moved to its retreated position. A drive plate 52 is secured to the front of the front flange 30 and includes a central opening through which the front end of the center 29 extends.

Reference will next be made to a mechanism for advancing and retreating the ram.

A screw shaft 39 is located within the spindle head 10 behind the ram 28. The screw shaft 39 is concentric with the ram 28 and is rotatably supported by a roller bearing 38. The screw shaft 39 includes at its front end a screw portion 39*a* for threaded engagement with a nut 40 which is, in turn, secured to the rear end of the ram 28. The screw shaft 39 has at its rear end a shaft portion 39*b* to which a gear 41 is mounted. A servo motor 42 is mounted to the spindle head 10 and has an output shaft to which a gear 43 is mounted for threaded engagement with the gear 41.

A driving unit C is attached to the drive plate 52 and may be in the form of a hydraulically operated automatic dog clutch or in the form of a drive dog clutch such as shown in the drawing figures. The servo motor 42 is connected to a control circuit 44 and is controlled in response to a signal produced by axial position sensors 15*a* and 15*b*.

Figure 4:
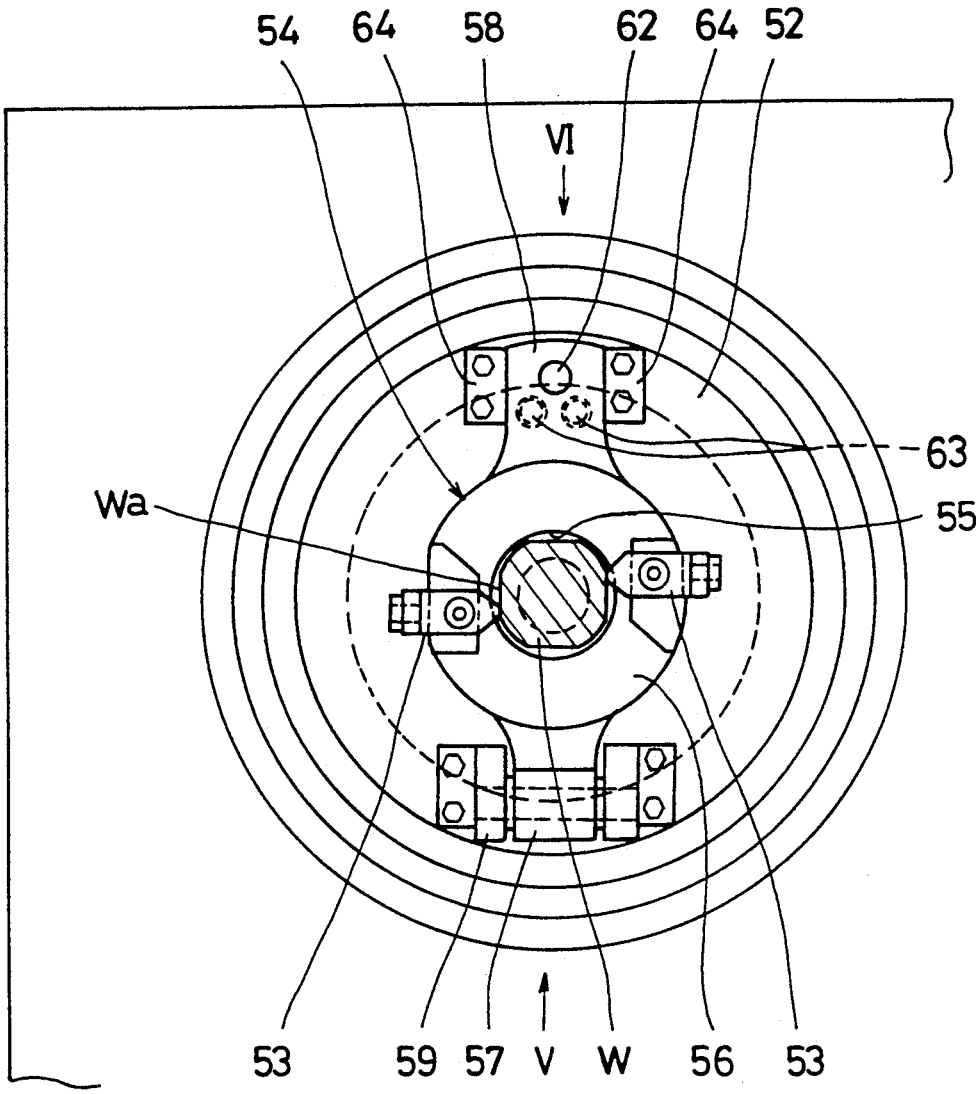
FIG. 4 is a sectional view taken along the line IV—IV of FIG. 3.
Figure 5:
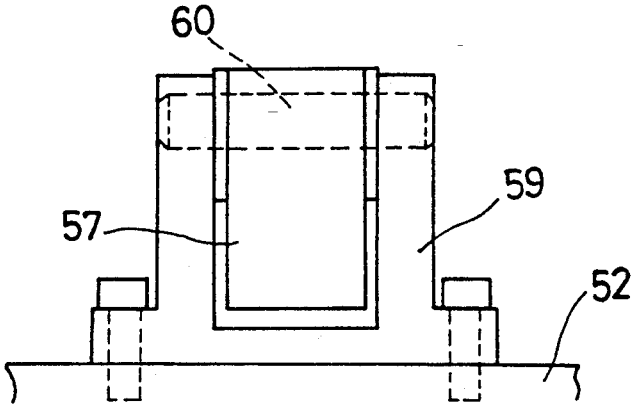
FIG. 5 is a view looking in the direction of the arrow V of FIG. 4.
Figure 6:
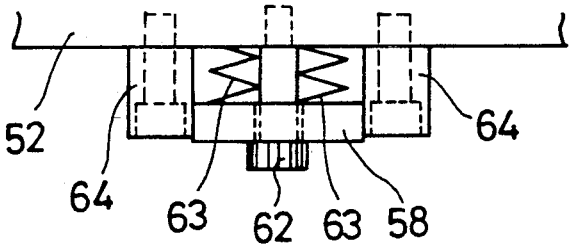
FIG. 6 is a view looking in the direction of the arrow VI of FIG. 4.

The structure of the driving unit C will be described with reference to FIGS. 4 to 6.

The driving unit C is pivotably mounted to the front of the drive plate 52 and generally includes a floating member 54 and a pair of pawls 53 and 53. The floating member 54 includes a ring 56 having a central opening 55, and a pair of diametrically opposite arms 57 and 58 extending outwardly from the ring 56. The pawls 53 and 53 extend from the ring 56 in a diametrically opposite relation and are 90° out of phase with respect to the arms 57 and 58. Each pawl 53 has a front end extending into the central opening 55. The drive plate 52 has a bracket 59 on its front. The bracket 59 has a pivot pin 60 about which the arm 57 of the floating member 54 is pivotable. The other arm 58 has an opening through which a bolt 62 extends. The bolt 62 is secured to the front of the drive plate 52 and has a head engaged with the front surface of the arm 58. Compression springs 58 and 58 are disposed between the front of the drive plate 52 and the arm 58 to bias the arm 58 so that the arm 58 may float relative to the drive plate 52. Guide elements 64 and 64 are attached to the drive plate 52 at opposite sides of the arm 58 so as to restrict displacement of the arm 58 in a circumferential direction.

With this arrangement, the floating member 54 is moved toward the drive plate 52 against the action of the springs 63 and 63 if interference of the pawl 53 of the ring 56 with the end of the workpiece W occurs.

The operation of the spindle apparatus for use in the grinder thus far described is as follows.

The tailstock spindle and the ram 28 are in their retreated position before abrasive action is initiated.

The workpiece W is placed temporarily on the workpiece stand-by stations 14*a* and 14*b* by a loader or similar means. Thereafter, the workpiece spindle 9 is rotated at a low speed by the motor 8. Also, the servo motor 42 is driven to rotate the screw portion 39*a* of the screw shaft 39 through the gears 43 and 41. This causes the ram 28 with the nut 40 to slide forward within the workpiece spindle 9. With a slight delay, the tailstock spindle 12 is advanced. The workpiece W on the workpiece stand-by stations 14*a* and 14*b* is then supported by the centers 11 and 29.

Under the circumstances, the floating member 54 may be moved toward the drive plate 52 against the action of the springs 63 and 63 in the event that the pawls 53 and 53 of the floating member 54 interfere with a portion of the workpiece W which is not bevelled.

Since the workpiece spindle 9 is rotated at a low speed, interference of the pawls 53 and 53 with the workpiece W will be eliminated within a short period of time.

Accordingly, when the ram 28 is moved to its advanced position, the pawls 53 and 53 are brought into engagement with a rotation transmission surface or bevel surface Wa which is formed on one end of the workpiece W. At this time, the axial position sensors 15*a* and 15*a* are moved forward to sense the axial position of the workpiece W. A signal indicative of the sensing is sent to the control circuit 44 so as to drive the servo motor 42 until the workpiece W is moved to a predetermined axial position. As a result, The ram 28 or the center 29 is advanced against the biasing force of the center 11 so as to hold the workpiece W in such a predetermined axial position.

The workpiece W can thus be held in position without moving the table 3.

Thereafter, the motor 8 is rotated at a higher speed to increase the speed of rotation of the workpiece W up to a predetermined level. The grinding wheels 4*a* and 4*b* are rotated by the motor 6 to initiate abrasive action.

The driving unit which is engaged with the workpiece W is rotated in the following manner. Rotation of the motor 8 is transmitted to the driving unit C through the joint 27, the gear shaft 20, the gears 26 and 25, the workpiece spindle 9, the spindle plate 24, the drive pin 23, the rotary sleeve 32 and the drive plate 52. At this time, the drive pin 23 is always engaged with the groove 35 of the rear flange 31 of the rotary sleeve 32 regardless of whether the ram 28 is moved forwards or rearwards. The rotation can always be transmitted to the workpiece W.

After the abrasive action has been completed, the wheel head 2 is retreated, and the motor 8 is stopped.

Thereafter, the tailstock spindle 12 is moved to its retreated position. The servo motor is then rotated in a reverse direction so as to slide the ram 28 back to its retreated position through the gears 43 and 41, the screw portion 42*a*, and the nut 42. The workpiece W is released from the centers 11 and 12, placed on the workpiece standby stations 14*a* and 14*b* and then, moved away from the grinder by the loader.

Obviously, numerous modifications and variations of the present invention are possible in light of the above teachings. It is therefore to be understood that within the scope of the appended claims, the present invention may be practiced otherwise than as specifically described herein.

What is claimed is:

1. A grinding machine for grinding a cylindrical workpiece comprising a bed, a spindle head mounted on the bed and having a spindle center, a tailstock mounted on the bed and having a tailstock center for supporting a workpiece together with the spindle center, and a wheel head carrying a grinding wheel, wherein the grinding machine is further provided with a workpiece stand-by station arranged on the bed at a location between the spindle head and the tail stock for temporarily supporting the workpiece thereon, wherein the spindle head comprises:

a workpiece spindle rotatably supported on the spindle head and driven for rotation by a motor, the workpiece spindle having a through bore;

a ram including a center for supporting the workpiece, the ram being supported within the through bore and axially slidable relative to the spindle in a direction parallel to the axis of the workpiece spindle;

a moving unit for moving the ram to an advanced position so as to support, via the center, the workpiece temporarily supported on the workpiece stand-by station and moving the ram to a retracted position so as to release the workpiece;

a drive member rotatably supported on a front end of the ram for axial movement with the ram and adapted to engage the workpiece in the direction of rotation when the ram is moved to the advanced position; and a mechanism for transmitting rotation of the workpiece spindle to the drive member at any axial position of the ram;

and wherein said grinding machine further comprises:

a measuring device arranged on the bed for detecting the longitudinal position of the workpiece; and a controller comprising means responsive to the measuring device for actuating the moving unit until the ram is moved from the retracted position to the advanced position, and further actuating the moving unit until an output signal of the measuring device indicates that the workpiece is located at a predetermined position.

2. A grinding apparatus according to claim 1, wherein said drive member includes a rotary sleeve rotatably supported on the front end of said ram, and a driving unit mounted to a front end of said rotary sleeve and adapted to engage the workpiece for rotation therewith when the ram is moved to the advanced position.

3. A grinding apparatus according to claim 2, wherein said mechanism for transmitting rotation includes a drive pin attached to the front end of the workpiece spindle and extending in a direction parallel to the axis of the spindle, and wherein said rotary sleeve includes an engagement portion for engagement with said drive pin in the direction of rotation at any axial position of the ram.

4. A grinding apparatus according to claim 1, wherein said moving unit includes a screw shaft located rearwardly of said ram and threadably engageable with said ram and a servomotor driven in response to said controller for rotating said screw shaft.

* * * * *